United States Patent [19]

Hattori et al.

[11] Patent Number: 4,619,442

[45] Date of Patent: Oct. 28, 1986

[54] COOLING BOX FOR STEEL MAKING FURNACES

[75] Inventors: Michinori Hattori, Fukuyama; Kazunori Niiya, Fukuyasu, both of Japan

[73] Assignee: Nippon Kokan Kabushiki Kaisha, Tokyo, Japan

[21] Appl. No.: 742,657

[22] Filed: Jun. 10, 1985

Related U.S. Application Data

[63] Continuation of Ser. No. 613,966, May 24, 1984, abandoned.

[30] Foreign Application Priority Data

May 26, 1983 [JP] Japan ..... 58-91503

[51] Int. Cl.[4] ..... F27D 1/12

[52] U.S. Cl. ..... 266/193; 122/6 B

[58] Field of Search ..... 266/193, 190; 122/6.5, 122/6 R, 6 B

[56] References Cited

U.S. PATENT DOCUMENTS

| | | | |
|---|---|---|---|
| 3,241,528 | 3/1966 | Loecher | 266/193 |
| 3,679,194 | 7/1972 | Jones et al. | 266/193 |
| 4,029,053 | 6/1977 | Higuchi | 266/193 |
| 4,245,982 | 1/1981 | Radoux et al. | 266/193 |

FOREIGN PATENT DOCUMENTS

| | | | |
|---|---|---|---|
| 2653042 | 5/1978 | Fed. Rep. of Germany | 266/193 |
| 2925127 | 1/1981 | Fed. Rep. of Germany | 266/190 |

*Primary Examiner*—L. Dewayne Rutledge
*Assistant Examiner*—S. Kastler
*Attorney, Agent, or Firm*—Moonray Kojima

[57] ABSTRACT

A cooling box is divided into cooling chambers, and each of the cooling chambers is communicated with a water pipe, so that each of the water supplies is independent. If a front part of the cooling box were lost by melting due to wearing of bricks in the furnace, cooling by the rear part of the cooling box would be available. Therefore, it is no longer necessary to substitute a new cooling box for an old one, since the cooling box by the invention could go with until the last period of the furnace and damages could be avoided of the furnace bricks in vicinity of the cooling box, which is caused inevitably by substituting a new cooling box for the old one.

1 Claim, 11 Drawing Figures

COOLING BOX FOR STEEL MAKING FURNACES

This is a continuation of application Ser. No. 613,966 filed May 24, 1984, now abandoned.

BACKGROUND OF THE INVENTION

This invention relates to an improved cooling box to be applied to a cooling system of steel making blast furnaces.

An explanation will be made to the prior art in reference to the attached drawings for clarification.

As cooling facilities to be applied to the blast furnace, there has been an exchangeable cooling box other than a cooling stave, which is as seen in FIG. 1. The shown cooling box 10 is in general produced by casting brass and provided with 2 to 6 water passages 11, and these passages are communicated with each other. The cooling box 10 is, as shown in FIG. 2, furnished within a wall of a furnace shaft 20 for protecting environmental bricks 21 and an iron shell 22 by passing the water therein. The brick is reduced in its thickness at a certain wearing rate as life of the furnace grows. FIGS. 3(*a*) and (*b*) show wearings of the bricks within the two furnaces. Lower parts of the shafts at 10 m from tuyeres were measured, and FIG. 4 shows in graph remaining thicknesses of the bricks 21 which are made in accompany with working period of year in the two furnaces. When the bricks 21 in the furnace become reduced in thickness as the working time goes, the cooling box 10 exposes its pointed end within the furnace as illustrated in FIG. 5. The exposed part is directly attacked by gas (1000° to 1400° C.) within the furnace, and the heat load from the furnace becomes higher to cause danger of loss by the molten material as seen in a flow chart in FIG. 6. If the heat load is suddenly effected on the furnace wall by slipping (i.e., sudden slide of the burden), the cooling water is boiled in the cooling box 10, and further a phenomenon of water hammer occurs by steam hunting in the cooling box 10. If a communicating pipe (lead pipe.flange packing) to the cooling box is damaged by the water haxmer phenomenon, water supply to the cooling box 10 is stopped and the cooling box 10 is lost by the molten material. When the water is boiled in the cooling box, pressure is lost by causing steam in water discharging pipes, so that pressure in the cooling box is made higher than pressure for supplying the cooling water, and the supply water to the cooling box 10 is stopped, and the cooling box 10 is molten away at last.

The cooling box 10 is prevented from melting loss by increasing the amount of the water supply, or applying mortar or other refractories to the furnace inside. The former of increasing the water supply heightens the electric fee for pumping the water, so that pig iron costs up inevitably. The cooling box 10 can be prevented from melting loss, however the exposed part at the pointed end thereof is bent downwardly, and this phenomenon considerably hinders smooth dropping of the burden in the furnace. In general, if life of the furnace is long, the furnace condition is unstable as much and the ratio of fuel is increased. These undesirable matters depend upon irregular dropping of the burden.

From these viewpoints, the conventional cooling box 10 as shown in FIG. 1 has recently been provided with multi-passages for a new blast furnace to be given initial kindling, having the cooling system in dependence upon the cooling box.

The damaged cooling box 10 may be substituted, unfortunately the bricks 21 in vicinity of the cooling box are much destroyed when substituting, and in case substitution were much, the iron shell 22 would be cracked.

The present invention has been provided to remove said defects involved about the prior cooling box. In the invention, the cooling box is divided into a plurality of chambers in a direction toward the furnace, and each of the cooling chambers is communicated with a water pipe, so that the water is charged and discharged independently. If the cooling box is effected with loss by melting as the bricks become wearing, it is no longer necessary to exchange the cooling box. The amount of the cooling water may be controlled.

Actual embodiment of the invention will be explained in reference to the attached drawings.

DETAILED DESCRIPTION OF THE INVENTION

Figure 1:
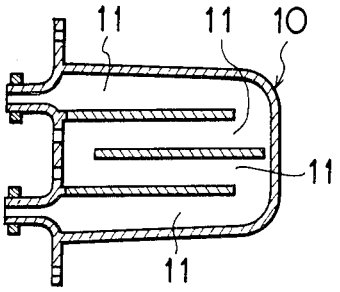
FIG 1 PRIOR ART
FIG. 1 is an explanatory view of a conventional cooling box.
Figure 3A:
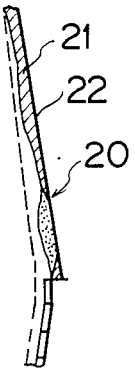
FIG 3(a) PRIOR ART
FIGS. 3(*a*) and (*b*) are cross sectional views showing wearing conditions of bricks in a furnace.
Figure 3B:
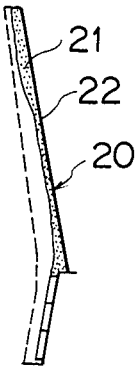
FIG 3(b) PRIOR ART
Figure 2:
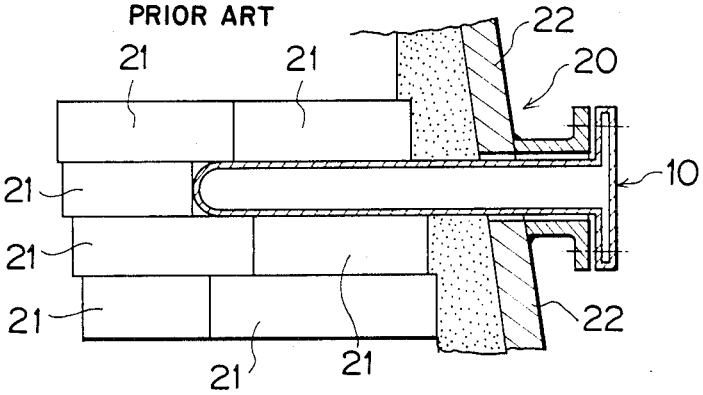
FIG 2 PRIOR ART
FIG. 2 is a partially enlarged view of a shaft of the furnace installed with said conventional cooling box.
Figure 4:
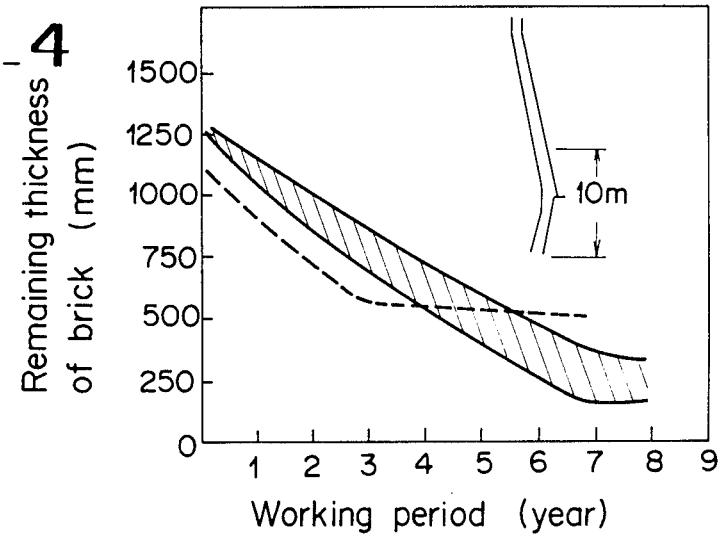
FIG 4 PRIOR ART
FIG. 4 is a graph showing remaining thickness of the bricks as the furnace works for years.
Figure 5:
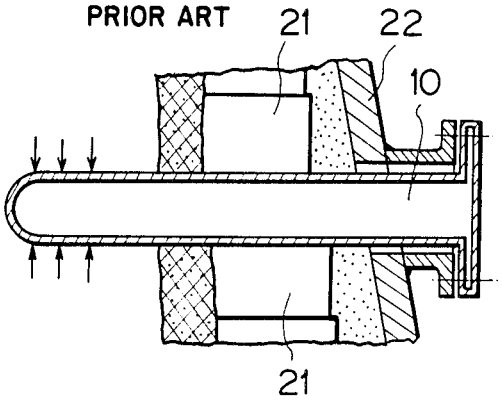
FIG 5 PRIOR ART
FIG. 5 is an explanatory view showing exposed condition of the cooling box in the furnace when the bricks are worn.
Figure 7:
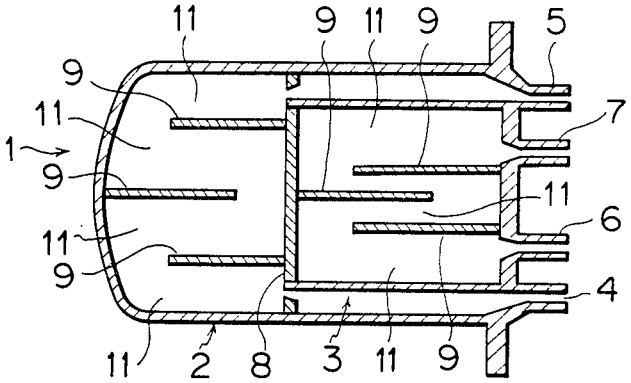
FIG. 7 is an explanatory view of a structure of an invented cooling box.

FIG. 7 shows an example of a cooling box 1 by the invention, which is divided into a plurality of cooling chambers, and these cooling chambers are independently communicated with water pipes 4 to 7 respectively.

The cooling box 1 is divided toward an inside of a furnace, and in this example it is divided into a front cooling chamber 2 and a rear cooling chamber 3 by a partition wall 8.

The front cooling chamber 2 alternately extends section walls 9 from the partition wall 8 and its wall, and four water passages 11 are formed. Also the rear cooling chamber 3 is provided with section walls 9 to form four water passages 11. Of course the number of the passage is not limited to the four passes.

The water pipes 4, 5 communicate with the front cooling chamber 2 for charging and discharging the water, while the water pipes 6, 7 communicate with the rear cooling chamber 3 for the same service.

The water from the water pipe 4 passes each of the passages 11 of the front cooling chamber 2 and gets out from the water pipe 5, while the water from the water pipe 6 passes the passages 11 of the rear cooling chamber 3 and gets out from the water pipe 7.

Figure 8:
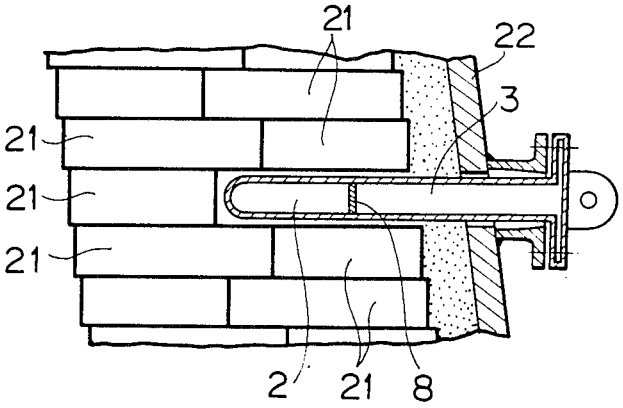
FIG. 8 is an outlined view of installing the invented cooling box when the furnace is constructed.
Figure 6:
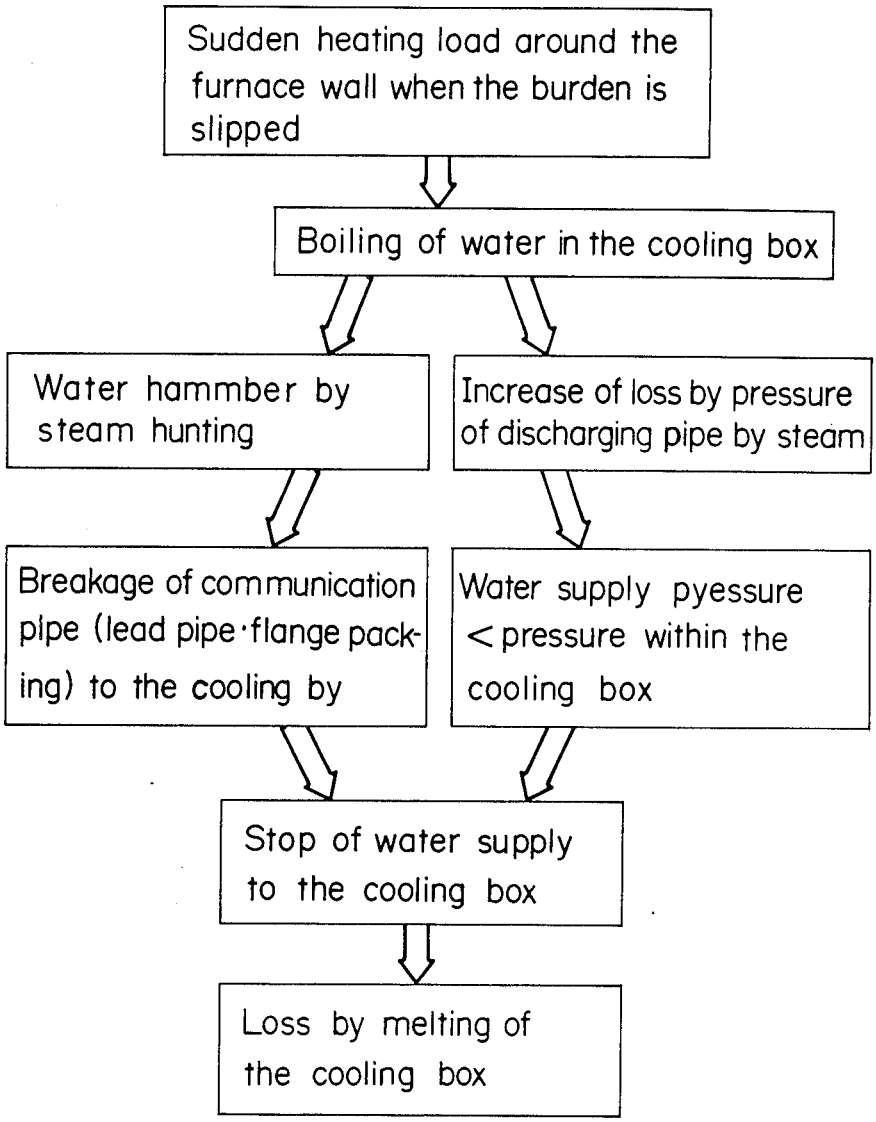
FIG 6 PRIOR ART
FIG. 6 is a flow chart showing wearing procession of the cooling box.

FIG. 8 shows an example where the cooling box 1 is installed from an iron shell 22 of the furnace shaft toward the inside of the furnace. The furnace is covered with bricks 21, and the front cooling chamber 2 is secured toward the center of the furance.

The cooling box 1 installed as mentioned above becomes chamged as the furnace works for years.

(1) Beginning period (Kindling to about 3 years)

In this period, the bricks 21 within the furnace are sound and almost as shown in FIG. 8. Conventionally, the cooling box 10 is generally worked with the amount of the supplied water of 4T/H. The cooling box 1 of the invention is divided at the part of about ½ with the partition wall 8, and since a heating area of the front cooling chamber 2 is about ½ of the whole, the amount of the supplied water is enough with 2T/H. The rear cooling chamber 3 is sufficient with the water flowing therein. Therefore, the whole of the cooling box 1 can be cooled with 3T/H in total. The water discharged from the rear cooling chamber 2 may be supplied into the rear cooling chamber 3. In this case, the water is further saved.

(2) Middle period (about 3 to 7 years from kindling)

Figure 9:
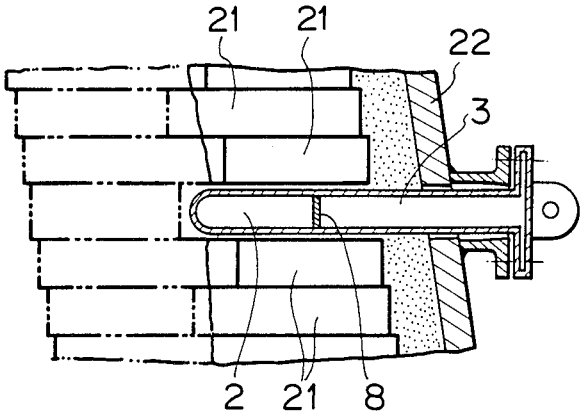
FIG. 9 is an explanatory view of the cooling box at the middle period of life of the furnace.

The bricks 21 are worn, and the pointed end of the cooling box 1 is exposed as shown in FIG. 9. By this wearing, the heating area of the front cooling chamber 2 is not changed, but by the exposure the heat receiving amount is increased. Therefore, the amount of the supplied water is 6T/H conventionally as countermeasure to the melting loss of the cooling box 10. In dependence upon the cooling box 1 of the invention, as the heating area of the front cooling chamber 2 is about ½ of the whole as said above, the amount of the water supplied thereto is sufficient with 3T/H, and the rear cooling chamber 3 is supplied with the water of 1T/H. Therefore, the amount of the supplied water is 4T/H as a whole with saving of the water of 2T/H.

If the front cooling chamber 2 is lost by melting, the water is stopped in chargihg and discharging and at the same time the amount of the water supplied to the rear cooling is increased from 3T/H to 4T/H.

The front cooling chamber 2 is molten away as stopping of supplying the water, but the loss by melting is stopped by means of the partition wall 8, and thereafter the cooling system by the cooling box depends upon only the rear cooling chamber 3. When the mortar or other refractories are blown, the water pipes 4, 5 may be used as supply mouthes of the refractory.

(3) Latter period (about 7 to 10 years after kindling)

Figure 10:
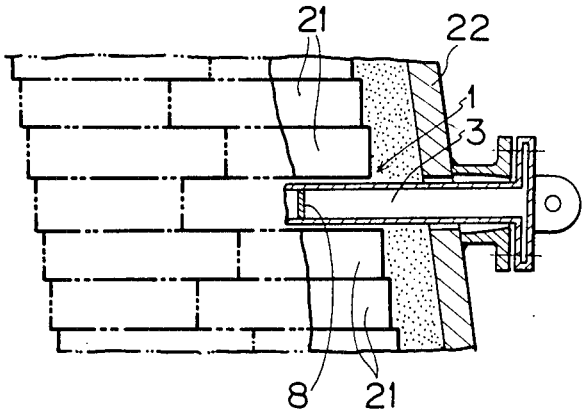
FIG. 10 is an explanatory view of the cooling box at the last period of life of the furnace.

The bricks 21 are considerable in wearing, and almost all of the front cooling chamber 2 is lost by melting. However the loss by melting is stopped at the partition wall 8 of the rear cooling chamber 3 as shown in FIG. 10, and as a result the cooling box 1 has a profile of ½ to ⅓ in length at the initial period.

If the water is supplied conventionally to the rear cooling chamber 3 with 10T/H, the water in this case may be sufficient with 5T/H.

Finally, the remaining thickness of the brick may be maintained for a long period of time by cooling the rear cooling chamber 3. It has been said that if the brick remains 200 mm in thickness, the iron shell is not cracked by red heat. Therefore, if the cooling box 1 according to the invention were adopted, the above mentioned deterioration at the latter period as seen in the furnace would be greatly reduced.

As having mentioned, depending upon the instant cooling box, although the front cooling chamber thereof were lost by melting due to wearing of the furnace bricks, the cooling by the rear cooling chamber would be available, and it is no longer necessary to exchange the cooling box, so that damages could be avoided of the furnace bricks in vicinity of the cooling box, which is caused inevitably by substitution of a new cooling box for an old one. Further, the invented cooling box has an excellent effect in lengthening the life of the furnace in accompany of continuity of the cooling effect thereby. In addition, the front cooling chamber is gradually molten away by wearing of the bricks, and since the cooling box may be controlled in length, such a phenomenon is not caused that the front portion of the cooling box is bent downwardly as seen conventionally. Therefore the smooth drop of the burden is preferably brought about, and the furnace condition may be maintained stable until the last period of the furnace. In the invention, the cooling box is divided into a plurality of the cooling chambers in length, and if the front part of the cooling box is molten away, it is sufficient to supply the water into the remaining cooling chamber, so that the amount of the supplied water may be curtailed than conventionally, and the electric fee for the water supplying power may be saved and the cost of the pig iron is lowered, accordingly.

What is claimed is:

1. A cooling box for steel making furnace, comprising a first cooling chamber comprising a first outer wall, a second outer wall having an inner surface and an outer surface, a third outer wall having an inner surface and an outer surface, a fourth outer wall having an inner surface and an outer surface, a first inner wall, a pair of second inner walls, a first inlet and a first outlet, wherein said first outer wall is connected with said furnace, said second and third outer walls extend into said furnace and said fourth outer wall forms an end of said first cooling chamber within said furnace, said pair of second inner walls are connected to and extend from said first outer wall toward said fourth outer wall, and said first inner wall is connected to and extends from said inner surface of said fourth outer wall toward said first outer wall and is disposed between said pair of second inner walls, said first inlet is formed in said first outer wall and is disposed between said inner surface of said second outer wall and one of said pair of second inner walls, and said first outlet is formed in said first outer wall and is disposed between said inner surface of said third outer wall and the other of said pair of second inner walls;

wherein a first coolant applied through said first inlet flows between said inner surface of said second outer wall and said one of said pair of second inner walls, then between said inner surface of said fourth outer wall and an unconnected end of said one of said pair of second inner walls, then between said one of said pair of second inner walls and said first inner wall, then between said first outer wall and an unconnected end of said first inner wall, then between said other of said pair of second inner walls and said first inner wall, then between said inner surface of said fourth outer wall and an unconnected end of said other of said pair of second inner walls, then between said other of said pair of second inner walls and said inner surface of said third outer wall, and then through said first outlet;

a second cooling chamber surrounding said first cooling chamber within said furnace and comprising a first outer wall, a second outer wall, a third outer wall, a fourth outer wall, a first inner wall, a pair of second inner walls, said outer surfaces of said second, third and fourth outer walls of said first cooling chamber, a second inlet, and a second outlet, wherein said first outer wall is in contact with said furnace, said second inlet and said second outlet are respectively formed in said first outer wall, said second outer wall is disposed outside of said second outer wall of said first cooling chamber and forms with said outer surface of said second outer wall of said first cooling chamber a first passageway connecting said second inlet to said second cooling chamber, said third outer wall is disposed outside of said third outer wall of said first cooling chamber and forms with said outer surface of said third outer wall of said first cooling chamber a second passageway connecting said second outlet to said second cooling chamber, said fourth outer wall of said first cooling chamber forming a common partition between said first and second cooling chambers with said inner surface thereof facing said first cooling chamber and said outer surface thereof facing said second cooling chamber, said first inner wall is connected to and extends from said fourth outer wall toward said outer surface of said fourth outer wall of said first cooling chamber, said pair of second inner walls are connected to and extend from said outer surface of said fourth outer wall of said first cooling chamber toward said fourth outer wall, with said first inner wall being disposed between said pair of second inner walls;

wherein a second coolant applied through said second inlet flows through said first passageway, then between said second outer wall and one of said pair of second inner walls, then between said fourth outer wall and an unconnected end of said one of said pair of second inner walls, then between said first inner wall and said one of said pair of second inner walls, then between said outer surface of said fourth outer wall of said first cooling chamber and an unconnected end of said first inner wall, then between said first inner wall and the other of said pair of inner walls, then between said fourth outer wall and an unconnected end of said other of said pair of second inner walls, then between said other of said pair of second inner walls and said third outer wall, and then through said second passageway, and then through said second outlet;

wherein said second coolant is supplied to said second cooling chamber at a higher volume rate than said first coolant is supplied to said first cooling chamber;

wherein said second, third and fourth outer walls of said second chamber are deteriorated first upon exposure to the inside of said furnace without affecting flow of first coolant in said first cooling chamber; and wherein said fourth outer wall of said first cooling chamber is disposed to be $\frac{1}{3}$ to $\frac{1}{2}$ the distance between said first outer wall of said second cooling chamber and said fourth wall of said second cooling chamber.

* * * * *